US007958859B2

(12) United States Patent
Methley et al.

(10) Patent No.: US 7,958,859 B2
(45) Date of Patent: Jun. 14, 2011

(54) CAMSHAFT ASSEMBLY

(75) Inventors: Ian Methley, Witney (GB); Richard Alwyn Owen, Banbury (GB); Nicholas James Lawrence, Buckingham (GB); Timothy Mark Lancefield, Shipston on Stour (GB)

(73) Assignee: Mechadyne PLC, Kirtlington (GB)

( * ) Notice: Subject to any disclaimer, the term of this patent is extended or adjusted under 35 U.S.C. 154(b) by 616 days.

(21) Appl. No.: 11/816,692

(22) PCT Filed: Mar. 13, 2006

(86) PCT No.: PCT/GB2006/050050

§ 371 (c)(1),
(2), (4) Date: Aug. 20, 2007

(87) PCT Pub. No.: WO2006/097767

PCT Pub. Date: Sep. 21, 2006

(65) Prior Publication Data

US 2010/0132640 A1 Jun. 3, 2010

(30) Foreign Application Priority Data

Mar. 18, 2005 (GB) ..... 0505496.0

(51) Int. Cl.
*F01L 1/04* (2006.01)

(52) U.S. Cl. ..... 123/90.6; 123/90.17; 29/888.1; 74/567

(58) Field of Classification Search ..... 123/90.6, 123/90.17; 29/888.1; 74/567
See application file for complete search history.

(56) References Cited

U.S. PATENT DOCUMENTS

| | | | | |
|---|---|---|---|---|
| 4,332,222 | A | 6/1982 | Papez et al. | |
| 5,664,463 | A * | 9/1997 | Amborn et al. | 74/567 |
| 5,809,954 | A * | 9/1998 | Devine et al. | 123/90.17 |
| 6,725,818 | B2 * | 4/2004 | Methley | 123/90.27 |

FOREIGN PATENT DOCUMENTS

| | | |
|---|---|---|
| DE | 4419557 | 10/1995 |
| DE | 10216767 | 10/2003 |
| EP | 1179657 | 2/2002 |
| GB | 2375583 | 11/2002 |

* cited by examiner

*Primary Examiner* — Thomas E Denion
*Assistant Examiner* — Daniel A Bernstein
(74) *Attorney, Agent, or Firm* — Chernoff, Vilhauer, McClung & Stenzel

(57) ABSTRACT

A camshaft assembly is disclosed which comprises an inner shaft, an outer tube surrounding and rotatable relative to the inner shaft, and two groups of cam lobes mounted on the outer tube, the first group of cam lobes being fast in rotation with the outer tube, the second group being rotatably mounted on the outer surface of the tube and connected for rotation with the inner shaft. The connection between the second group of cam lobes and the inner shaft is effected by means of driving members whose positions are adjustable in order to compensate for significant manufacturing inaccuracies between the inner shaft and its associated group of cam lobes.

9 Claims, 6 Drawing Sheets

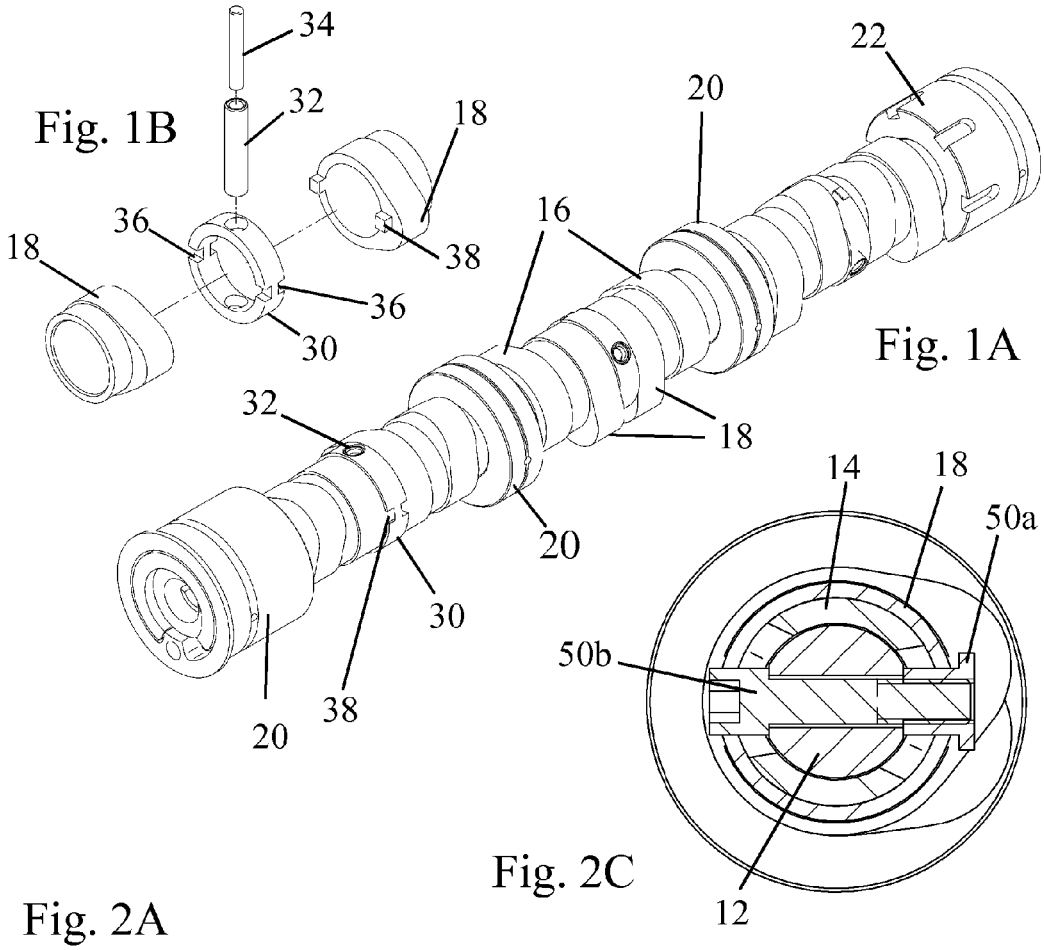
Fig. 1B
Fig. 1A
Fig. 2C
Fig. 2A
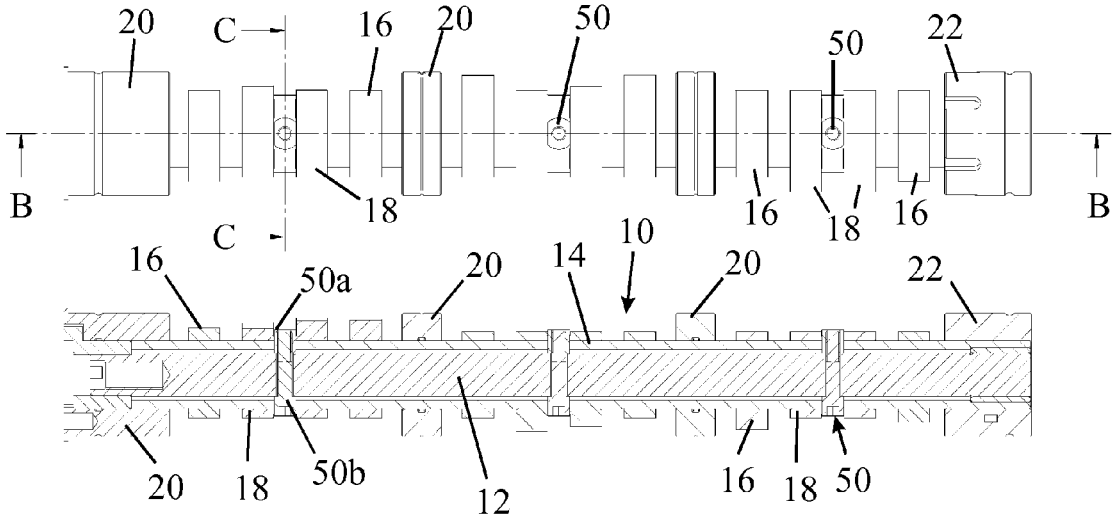
Fig. 2B

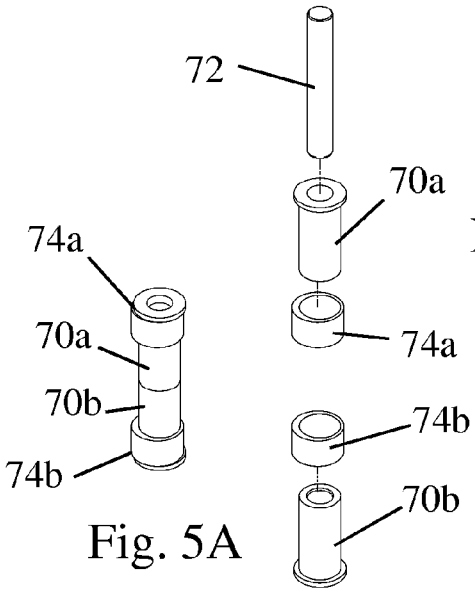
Fig. 5A
Fig. 5B
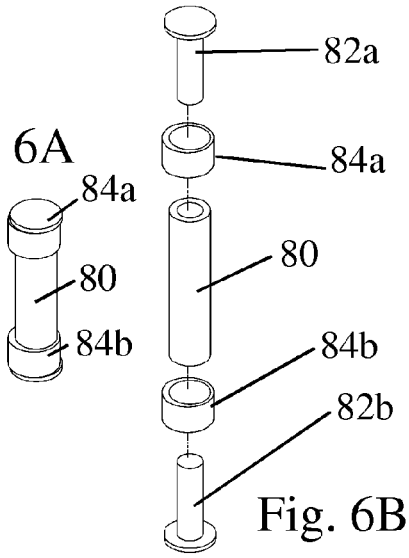
Fig. 6A
Fig. 6B
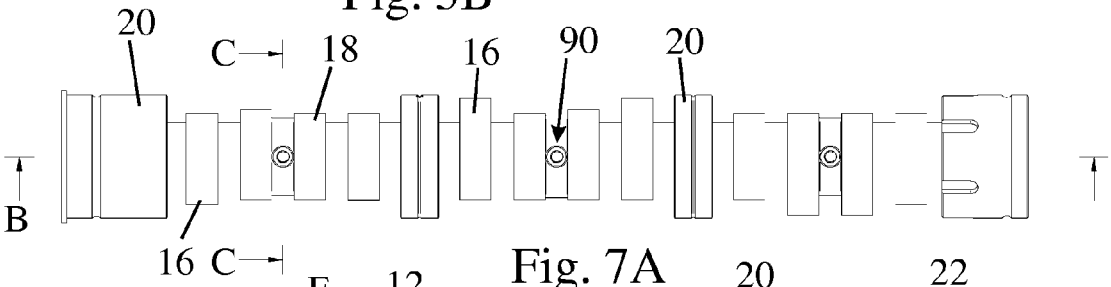
Fig. 7A
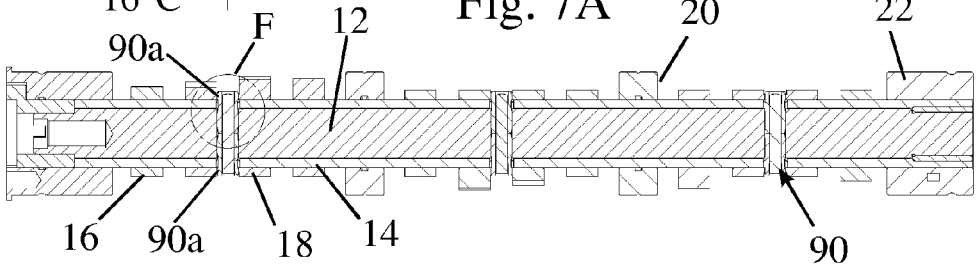
Fig. 7B
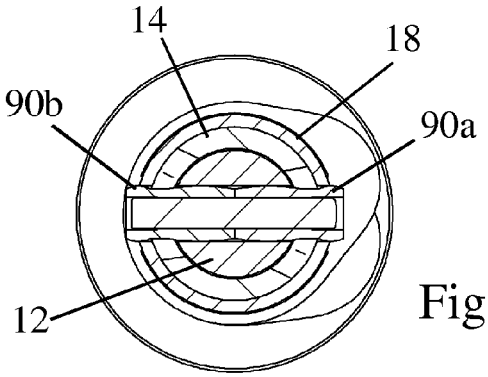
Fig. 7C
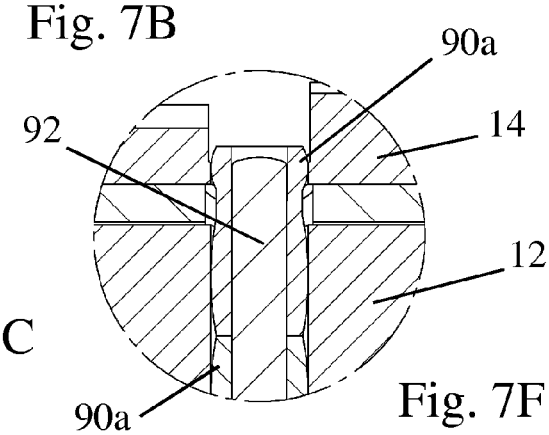
Fig. 7F

CAMSHAFT ASSEMBLY

FIELD OF THE INVENTION

The invention relates to a camshaft assembly comprising an inner shaft, an outer tube surrounding and rotatable relative to the inner shaft, and two groups of cam lobes mounted on the outer tube, the first group of cam lobes being fast in rotation with the outer tube while the second group is rotatably mounted on the outer surface of the tube and is connected for rotation with the inner shaft. This type of camshaft assembly is also termed a single cam phaser (SCP) camshaft, because it allows the timing of two groups of cam lobes on the same camshaft to be varied in relation to one another by relative rotation of the outer tube and the inner shaft.

BACKGROUND OF THE INVENTION

It is well known that an SCP camshaft can be very sensitive to component manufacturing tolerances and that the component parts must be made to an accurate specification in order for the camshaft to function correctly. This has an adverse effect upon the manufacturing costs of the camshaft.

In particular, the alignment of the holes in the drive shaft and the cam lobes through which each connecting pin is fitted is critical. If significant misalignment is present, the fitting of the connecting pin will act to align the holes and this will cause the drive shaft to lock in its bearings inside the camshaft tube. Variation in components due to manufacturing tolerances can therefore result in the inner shaft being unable to rotate relative to the outer tube of the camshaft. An example of the current practice for connecting cam lobes to the inner drive shaft is shown in GB-A-2375583.

OBJECT OF THE INVENTION

The present invention seeks to overcome the effect of manufacturing tolerances by providing a method for connecting the camshaft lobes to the inner drive shaft that allows the shaft to control the angle of the cam lobes, but does not dictate the axis of rotation of the drive shaft.

SUMMARY OF THE INVENTION

According to the present invention, there is provided a camshaft assembly comprising an inner shaft, an outer tube surrounding and rotatable relative to the inner shaft, and two groups of cam lobes mounted on the outer tube, the first group of cam lobes being fast in rotation with the outer tube, the second group being rotatably mounted on the outer surface of the tube and connected for rotation with the inner shaft by means of driving members whose positions are adjustable in order to compensate for significant manufacturing inaccuracies between the inner shaft and its associated group of cam lobes.

In one embodiment of the invention, the driving members comprise a drive pin and a drive sleeve, the drive pin being firmly received in a transverse bore in the inner shaft of the camshaft and the drive sleeve being loosely mounted to surround the outer tube of the camshaft, and wherein the drive sleeve is firmly engaged by the drive pin and is coupled to cam lobes that are rotatably mounted on the outer tube by formations that permit the drive sleeve to move transversely to the axis of the drive pin.

In an alternative embodiment of the invention, the driving members are constituted by a compound driving pin formed of a plurality of parts having contact surfaces for mating with the inner shaft of the camshaft and the cam lobes on the outer tube, the contact surfaces being movable to allow them to be separately aligned with the inner shaft and the cam lobes during assembly and being lockable in situ to maintain their correct alignment after assembly.

As can be seen, the driving members may take on a wide variety of different forms, but the novelty of the invention does not reside in the particular form that the driving members adopt. The invention is predicated on the realisation that the driving members must allow for the fact that the coupling formations, usually holes, in the drive shaft and the associated cam lobes are not always necessarily in perfect alignment with one another and it does not therefore suffice simply to drive a cylindrical pin through such holes.

The different embodiments of the invention offer the advantage that components can be manufactured to a lower level of accuracy, resulting in reduced overall system cost. Furthermore, certain embodiments of the invention offer additional possibilities for designing moving cam lobes as a sub-assembly, to simplify the assembly process.

BRIEF DESCRIPTION OF THE DRAWINGS

The invention will now be described further, by way of example, with reference to the accompanying drawings, in which:

FIG. 1A is a perspective view of an SCP camshaft of a first embodiment of the invention, FIG. 1B is a exploded view of the driving connection between the inner shaft and a movable cam lobe in the embodiment of FIG. 1A, FIG. 2A is a side view of an SCP camshaft of a second embodiment of the invention, FIG. 2B is a section along the line B-B in FIG. 2A, FIG. 2C is a section along the line C-C in FIG. 2A, FIG. 5A shows a perspective view of a multi-part driving pin, FIG. 5B is an exploded view of the driving pin of FIG. 5A, FIGS. 6A and 6B are view similar to FIGS. 5A and 5B respectively showing an alternative design of a multi-part driving pin, FIG. 7A to 7E are views corresponding to FIGS. 2A to 2E respectively showing a further embodiment of the invention, and FIG. 7F shows the part of FIG. 7B contained with the circle designated F drawn to an enlarged scale.

DETAILED DESCRIPTION OF THE PREFERRED EMBODIMENTS

Figure 2D:
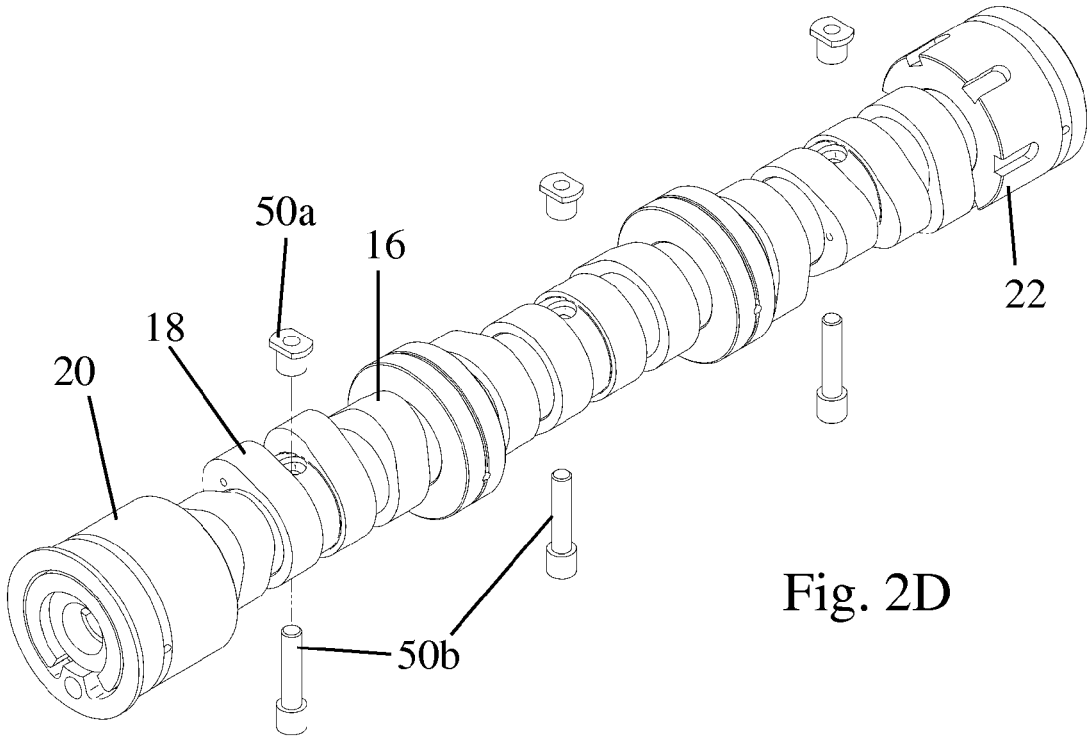
FIG. 2D is a partially exploded perspective view of the camshaft of FIG. 2A.
Figure 4A:
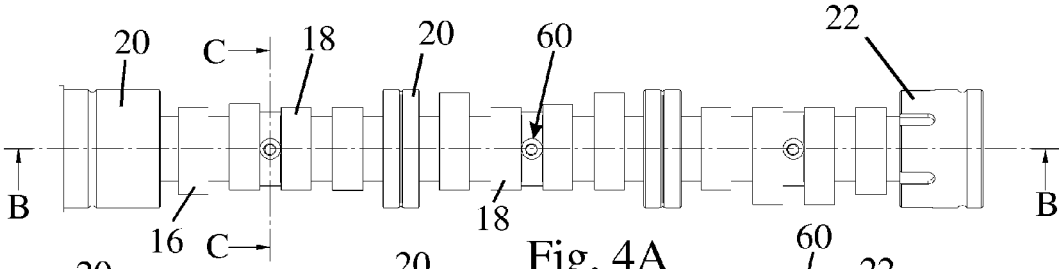
FIG. 4A to 4E are views corresponding to FIGS. 2A to 2E respectively showing a fourth embodiment of the invention.
Figure 4B:
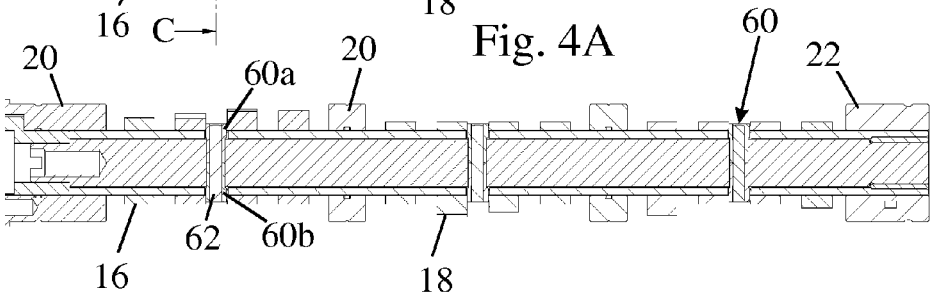
Figure 4C:
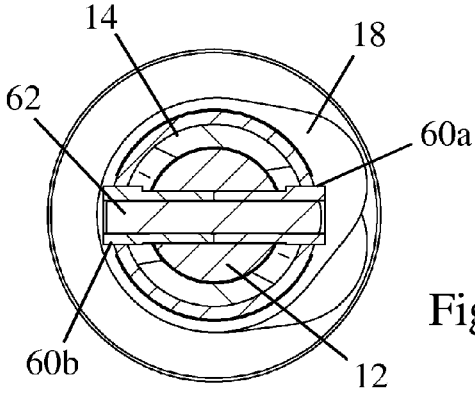
Figure 4D:
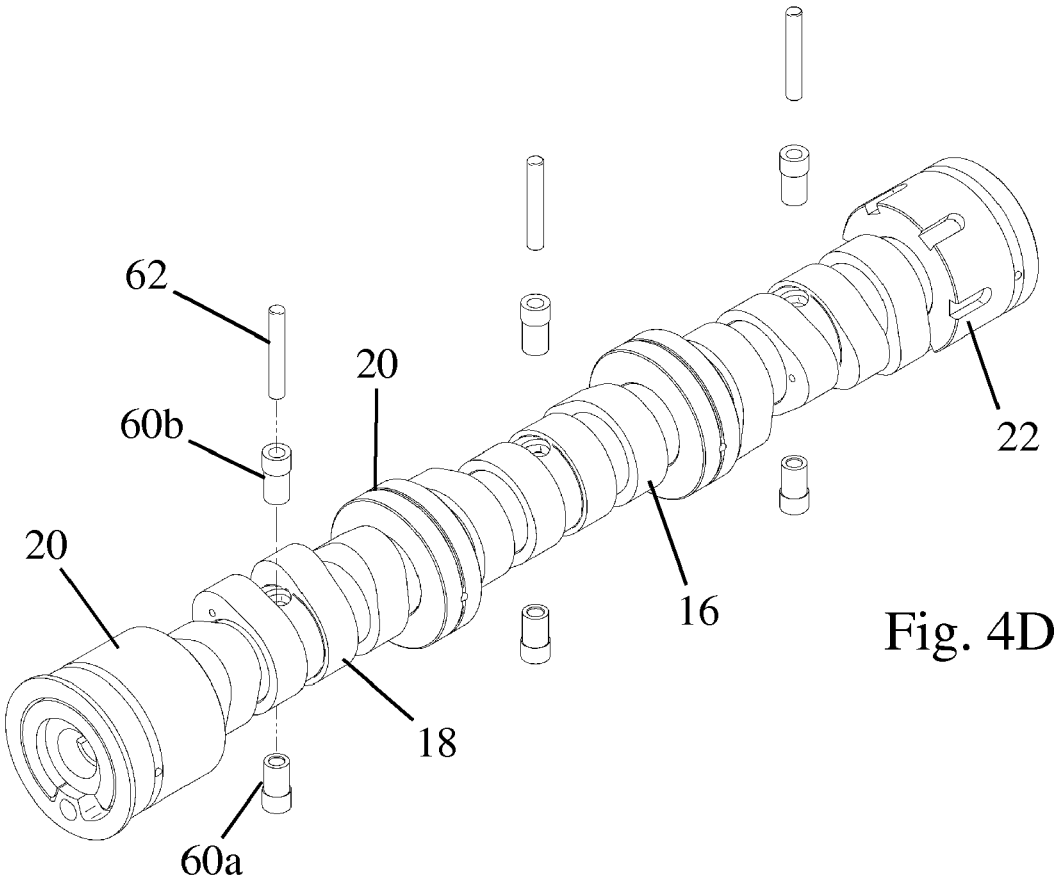
Figure 4E:
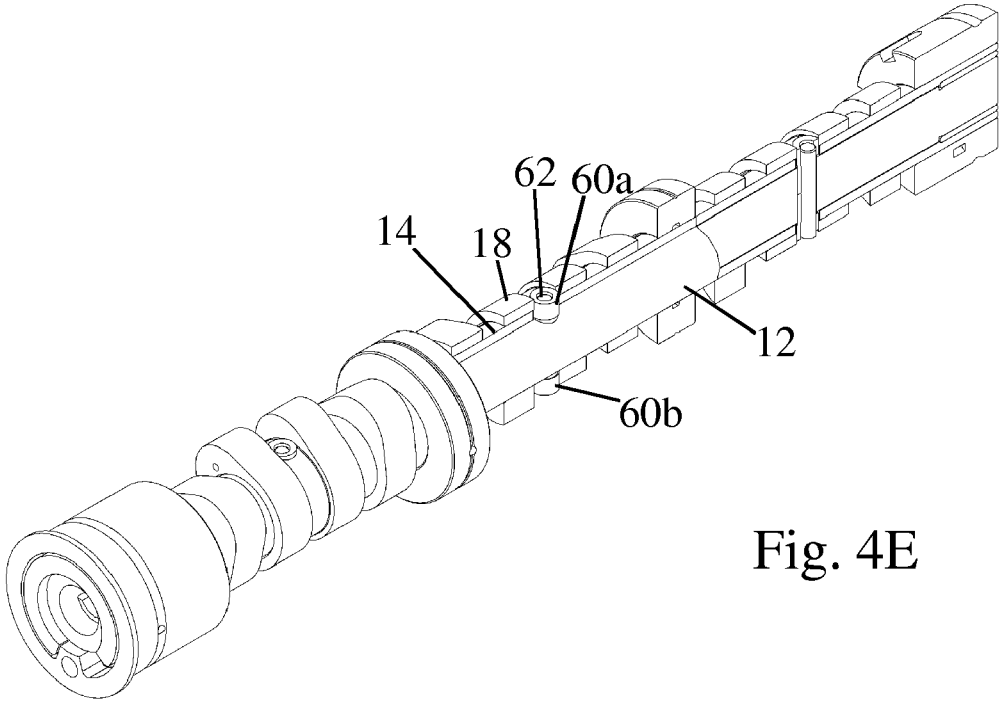

The construction and principle of operation of SCP camshafts is well known and will not be described herein in detail. The sections of FIGS. 2B, 4B and 7B suffice to explain their operation for the present context. Each of these camshafts 10 has an inner shaft 12 surrounded by an outer tube 14. Selected cam lobes 16 are firmly mounted (such as by heat shrinking) on the outer tube and are fast in rotation with the outer tube 14. Other cam lobes 18 are journalled to rotate freely about the outer tube 14 and are connected by a driving connection, which is the subject of the present invention, for rotation with the inner shaft 12. In this way, rotating the inner shaft 12 relative to the outer tube 14 has the effect of altering the phase of the cam lobes 18 relative to the cam lobes 16. A crankshaft driven phaser (not shown) mounted to one end of the camshaft drives the camshaft 10 and allows the phase of the outer tube 14 and/or the inner shaft 12 to be set as desired relative to the phase of the engine crankshaft. In addition to cam lobes 16 and 18, the outer tube 14 carries bearing sleeves 20 for rotatably supporting the camshaft in pillar blocks in the engine cylinder block or cylinder head and sensor rings 22 to permit the angular positions of the inner shaft 12 and/or the outer tube 14 to be measured.

The problem addressed by the present invention can readily also be understood from FIG. 2B. The connection between the cam lobes 18 and the inner shaft 12 is conventionally established by inserting a straight pin into aligned holes in the inner shaft and the cam lobes. However, such alignment is subject to manufacturing tolerances and, in the event of a slight inaccuracy, the insertion of the pin can force one or other of the inner shaft and the outer tube off axis with the result that the two are locked and cannot rotate relative to the camshaft tube 14.

To mitigate this problem, in the embodiment of FIGS. 1A and 1B a coupling sleeve 30 is loosely fitted over the camshaft tube 14 and is connected for rotation with the inner drive shaft 12 via a connecting pin 32, which is itself locked in position in the inner shaft 12 by means of a fixing peg 34. The coupling sleeve has key slots 36 in its two faces that transfer drive to the adjacent cam lobes 18 via dogs 38 or other keying formations protruding from their faces.

If the axes of the key slots 36 in the sleeve 30 are perpendicular to the axis of the connecting pin 32, the axis of rotation of the cam lobes 18 will be completely independent from that of the inner drive shaft 12. Therefore any manufacturing inaccuracies in the positions of the connecting pin bores will not cause the camshaft to lock.

A further advantage offered by this embodiment of the invention is that the moving cam lobe components may all be identical if the angle of the connecting pin bore is chosen carefully. A collar on the sides of the moving cam lobes can prevent them from moving apart, which would cause the keying formations to become disengaged.

Figure 2E:
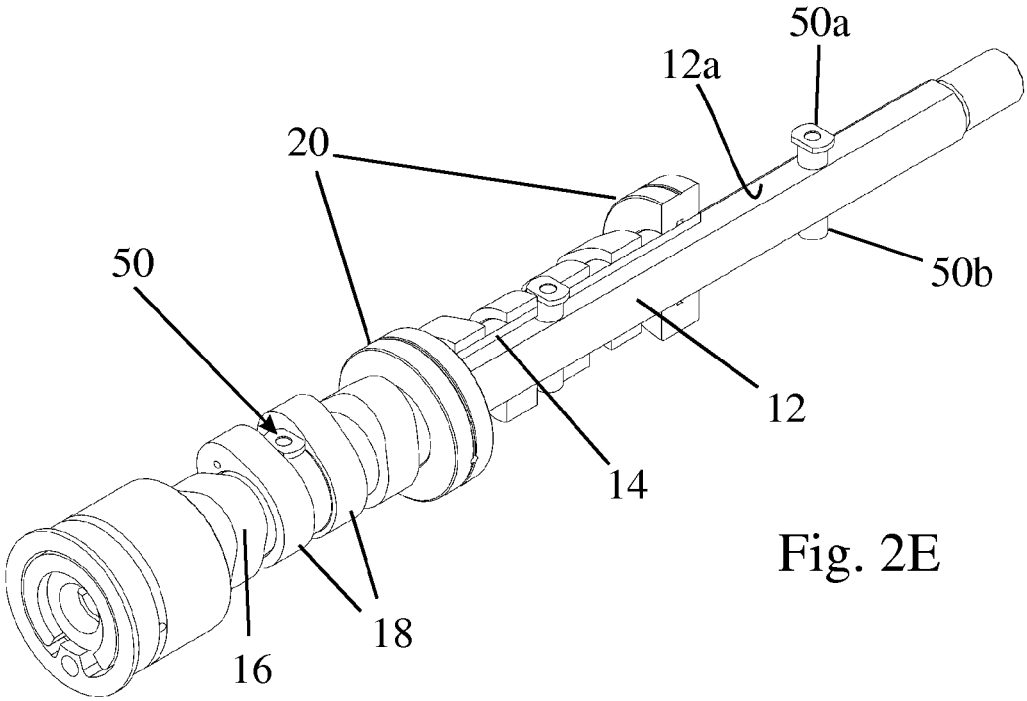
FIG. 2E is a partially cut-away perspective view of the camshaft of FIG. 2A.

In the embodiment of the invention shown in FIG. 2A to 2E, the movable cam lobes 18 are connected to the inner drive shaft 12 via a two-piece connecting pin 50 constructed as a nut 50*a* and a bolt 50*b*. The shank of the bolt 50*b* passes with clearance through a hole in the drive shaft 12, whilst the head of the bolt 50*b* and the nut 50*a* ends are a tight clearance or interference fit in the cam lobe 18. The nut 50*a* and the bolt 50*b* constituting the connecting pin 50 can be clamped to flat surfaces 12*a* provided on each side of the drive shaft 12 (as best shown in FIG. 2E).

The angular alignment of the connecting pin 50 is dictated by the flat surfaces 12*a* of the drive shaft 12, but the position of the connecting pin axis is dictated only by the bore in the moving cam lobe 18, not the bore through the drive shaft. Hence the bore in the drive shaft can be machined less accurately because any misalignment with respect to the connecting pin bore in the cam lobe will simply result in the connecting pin taking up an eccentric position.

It can be seen from the cutaway view of FIG. 2E that the inner shaft 12 may be machined with two flats 12*a* along its whole length, which eliminates any angular tolerance between different connecting pins. This is not however a requirement of this design, as it would be alternatively possible to have a counter-bore on each end of the holes through the shaft to provide a seat for the two halves of the connecting pins.

The nut 50*a* of the connecting pin 50 is shown with two anti-rotation flats to aid assembly, but there are many alternative designs. All that is required is some method, such as a slot, to prevent the nut 50*a* from rotating as the connecting pin is tightened.

Figure 3A:
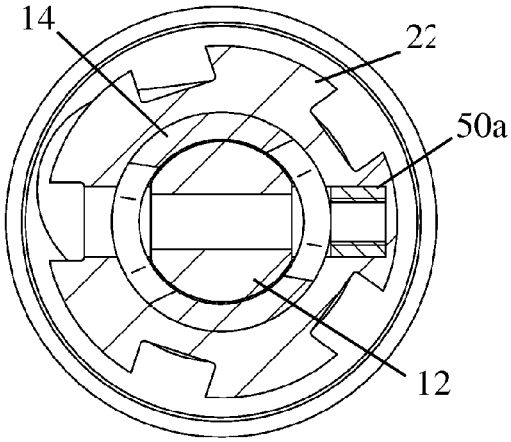
FIG. 3A is section similar to that of FIG. 2C showing a modification of the second embodiment of the invention using blind bores in a cam lobe or sensor ring.
Figure 3B:
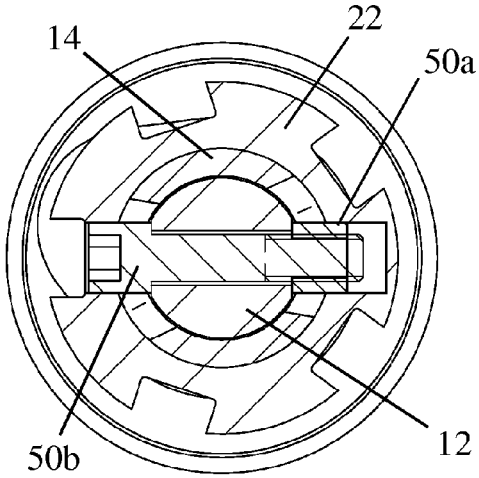
FIG. 3B is section similar to that of FIG. 3A but showing the position of the components after they have been locked in place.

In some cases, it is not possible to design sensor rings or cam lobes with through-holes for receiving a connecting pin. As is shown in FIGS. 3A and 3B, the concept of using a connecting pin designed as a nut and bolt can be adapted to suit such situations by allowing the nut 50*a* to sit captive in a blind bore in the sensor ring 22 (or a cam lobe if necessary). Conventional hollow pins with an expanding peg pushed into their bore could be used in these cases, but they would interfere with dismantling of the camshaft.

The section of FIG. 3A shows the nut 50*a*, as it would be positioned for assembly of the sensor ring on to the outer tube 14. The section of FIG. 3B shows the final assembled arrangement where the bolt 50*b* has drawn the nut 50*a* out of the bore in the sensor ring 22 and clamped it into position on the flat surface of the inner drive shaft 12.

The embodiment of FIGS. 4A to 4E uses a connecting pin 60 formed in two halves 60*a* and 60*b*, each of which has a tubular section which engages firmly in a bore in the inner shaft 12 and an eccentric head that engages firmly in a hole in the cam lobe 18. Any variation in manufacturing tolerances will be compensated for by the rotational position taken up the eccentrics.

The connecting pin 60 is made up of two identical parts 60*a* and 60*b* that can be assembled into each side of the moving cam lobe 18. The two parts of the connecting pin 60 are then secured in place by inserting an interference fit peg 62 through the centre. The peg 62 expands the connecting pin 60 to retain it in the inner drive shaft 12.

It should be noted that the eccentrics are not offset along the axis of the camshaft, but rather at an angle of around 45° to the camshaft axis. This configuration is created by machining the bores in the inner drive shaft 12 and the moving cam lobes 18 with a deliberate offset. Variations in manufacturing tolerances will then cause the installed eccentric angle to vary either side of 45°. This approach increases the stiffness of the connecting pins and ensures that the eccentrics will not rotate when torque is applied to the cam lobes 18.

A number of different designs are possible for creating eccentrics on the connecting pin. In FIGS. 5A and 5B loose eccentric sleeve components 74*a* and 74*b* are simply retained in position and are free to rotate to the most 'ideal' position at all times about the shank 70*a* and 70*b* of the connecting pins. Similarly in FIGS. 6A and 6B, loose sleeves 84*a* and 84*b* are free to rotate relative to the central shank 80 about the fixing pegs 82*a* and 82*b* serving to retain the central shank 80 in a transverse bore of the inner shaft 12.

Figure 7D:
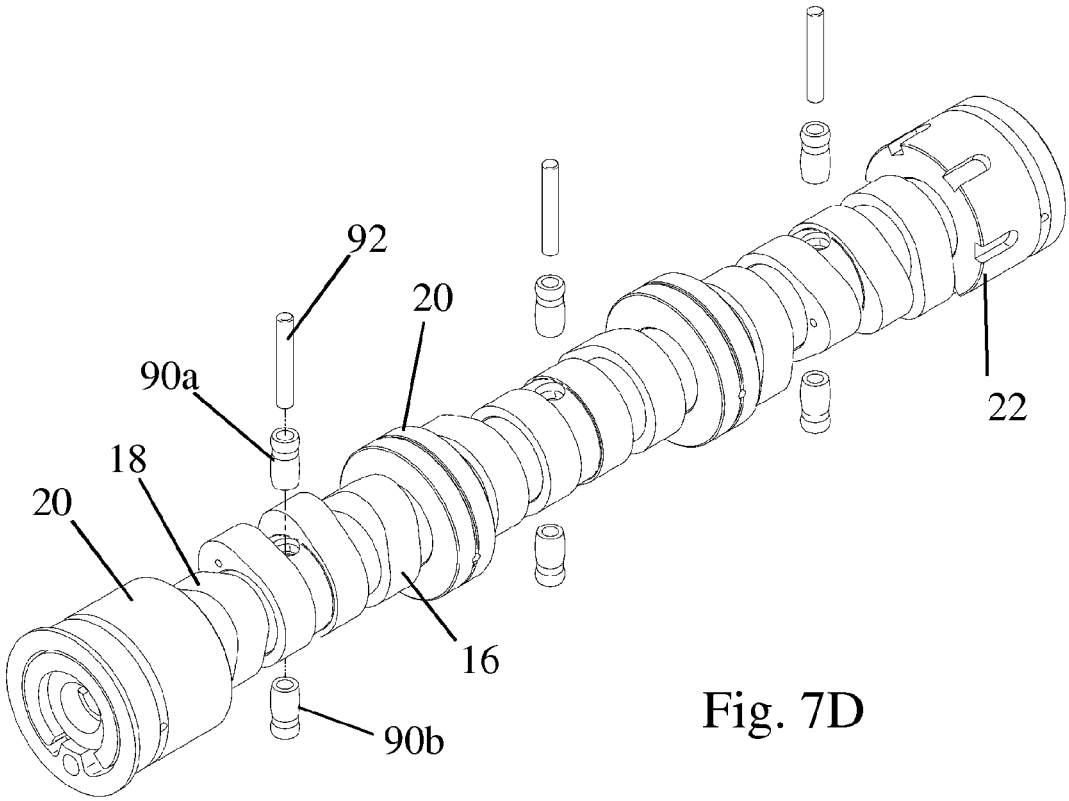
Figure 7E:
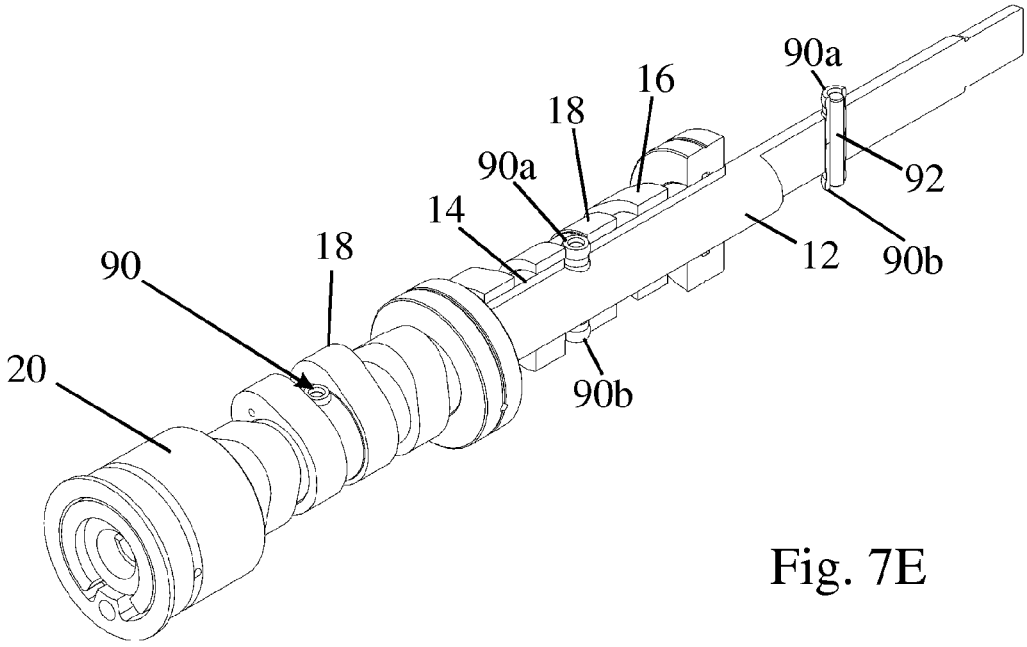

The embodiment of FIGS. 7A to 7F uses two connecting pins 90 made up of two parts 90*a* and 90*b* with barrelled surfaces in contact with the bores of the inner drive shaft and the moving cam lobes. The barrelling of the pin parts is best shown in FIG. 7F, where it is much exaggerated for ease of understanding. In reality, the barrelling would be closer to that found on a needle roller element.

The barrelling of the pin parts 90*a* and 90*b* allows their position to compensate for any manufacturing tolerances in the inner drive shaft and the cam lobe because the barrelled pins are not constrained to lie on the axis of either bore.

Once inserted, the connecting pins are retained by an additional peg 92 pressed through their central bore. If a single peg 92 is used to lock the parts 90*a* and 90*b* of the connecting pin 90 in position, it is possible for final machining (reaming etc) of the central bores of the connecting pins to be carried out after they have been assembled into the camshaft. This will ensure that the peg 92 will lock them in the ideal position when it is inserted and not force them into a new position that could cause the camshaft to jam.

It would alternatively be possible to have separate pegs 92, one in each connecting pin part so that the connecting pin parts could be finish machined before assembly.

The invention claimed is:

1. A camshaft assembly comprising an inner shaft, an outer tube surrounding and rotatable relative to the inner shaft, and two groups of cam lobes mounted on the outer tube, the first group of cam lobes being fast in rotation with the outer tube, the second group being rotatably mounted on the outer surface of the tube and connected for rotation with the inner shaft by means of driving members that engage with driving features on the inner shaft and the second group of cam lobes and extend through circumferentially elongated slots in the outer tube, whereby the inner shaft and the second group of cam lobes are able to rotate relative to the outer tube and the first group of cam lobes, wherein the positions of the driving members are adjustable relative to the driving features on the inner shaft or the driving features on the second group of cam lobes in order to compensate for variations in the positions of the driving features on the inner shaft and the second group of cam lobes in a direction perpendicular to the axis of the inner shaft resulting from manufacturing inaccuracies.

2. A camshaft assembly as claimed in claim 1, wherein the driving members comprise a drive pin and a drive sleeve, the drive sleeve having an axis parallel to that of the outer tube of the camshaft and being loosely mounted to surround the outer tube and the drive pin being firmly received in a transverse bore in the inner shaft of the camshaft, and wherein a transverse bore in the drive sleeve is firmly engaged by the drive pin and the drive sleeve is coupled to cam lobes that are rotatably mounted on the outer tube by formations that permit the drive sleeve to move relative to the second group of cam lobes in a direction perpendicular to the axis of the drive pin.

3. A camshaft assembly as claimed in claim 1, wherein the driving members are constituted by a compound driving pin formed of a plurality of parts having contact surfaces for mating with the inner shaft of the camshaft and the cam lobes on the outer tube, the contact surfaces being movable to allow them to be separately aligned with the inner shaft and the cam lobes during assembly and being lockable in situ to maintain their correct alignment after assembly.

4. A camshaft assembly as claimed in claim 1, wherein the driving members comprise a pin structure, the driving features on the second group of cam lobes comprise two holes, the driving features on the inner shaft comprise a hole that extends through the inner shaft and is located between and substantially aligned with the holes in the second group of cam lobes, the pin structure extends through the hole in the inner shaft and the holes in the second group of cam lobes, and the pin structure engages with the hole in the inner shaft and the holes in the second group of cam lobes in a manner that allows variation in position of the hole in the inner shaft relative to the holes in the second group of cam lobes in a direction perpendicular to the central axis of the inner shaft.

5. A camshaft assembly comprising an inner shaft, an outer tube surrounding and rotatable relative to the inner shaft, and two groups of cam lobes mounted on the outer tube, the first group of cam lobes being fast in rotation with the outer tube, the second group being rotatably mounted on the outer surface of the tube and connected for rotation with the inner shaft by means of driving members that engage with driving features on the inner shaft and the second group of cam lobes, wherein the positions of the driving members are adjustable in order to compensate for variations in the positions of the driving features on the inner shaft and the second group of cam lobes in a direction perpendicular to the axis of the inner shaft resulting from manufacturing inaccuracies, the driving members are constituted by a compound driving pin formed of a plurality of parts having contact surfaces for mating with the inner shaft of the camshaft and the cam lobes on the outer tube, the contact surfaces being movable to allow them to be separately aligned with the inner shaft and the cam lobes during assembly and being lockable in situ to maintain their correct alignment after assembly, and the compound drive pin comprises a nut and bolt, the head of the bolt and the nut being firmly engaged in holes in a cam lobe and the shank of the bolt passing with clearance through a transverse bore in the inner shaft, the nut and bolt being tightened after assembly to apply a clamping pressure on opposite sides of the inner shaft.

6. A camshaft assembly comprising an inner shaft, an outer tube surrounding and rotatable relative to the inner shaft, and two groups of cam lobes mounted on the outer tube, the first group of cam lobes being fast in rotation with the outer tube, the second group being rotatably mounted on the outer surface of the tube and connected for rotation with the inner shaft by means of driving members that engage with driving features on the inner shaft and the second group of cam lobes, wherein the positions of the driving members are adjustable in order to compensate for variations in the positions of the driving features on the inner shaft and the second group of cam lobes in a direction perpendicular to the axis of the inner shaft resulting from manufacturing inaccuracies, the driving members are constituted by a compound driving pin formed of a plurality of parts having contact surfaces for mating with the inner shaft of the camshaft and the cam lobes on the outer tube, the contact surfaces being movable to allow them to be separately aligned with the inner shaft and the cam lobes during assembly and being lockable in situ to maintain their correct alignment after assembly, and the compound pin comprises eccentric sleeves that are independently rotatable to permit their separate alignment in holes in the cam lobes and the inner shaft during assembly and means for locking the sleeves to one another so as to prevent their relative rotation after their assembly.

7. A camshaft assembly comprising an inner shaft, an outer tube surrounding and rotatable relative to the inner shaft, and two groups of cam lobes mounted on the outer tube, the first group of cam lobes being fast in rotation with the outer tube, the second group being rotatably mounted on the outer surface of the tube and connected for rotation with the inner shaft by means of driving members that engage with driving features on the inner shaft and the second group of cam lobes, wherein the positions of the driving members are adjustable in order to compensate for variations in the positions of the driving features on the inner shaft and the second group of cam lobes in a direction perpendicular to the axis of the inner shaft resulting from manufacturing inaccuracies, the driving members are constituted by a compound driving pin formed of a plurality of parts having contact surfaces for mating with the inner shaft of the camshaft and the cam lobes on the outer tube, the contact surfaces being movable to allow them to be separately aligned with the inner shaft and the cam lobes during assembly and being lockable in situ to maintain their correct alignment after assembly, and the pin is formed in two parts that are each barrelled such that each part may be inserted in a transverse bore in the inner shaft of the camshaft with its axis misaligned with the bore axis to a sufficient extent for the end of the pin part to engage centrally in a hole in a cam lobe, the two pin parts being locked in position after their assembly in the cam lobes and the inner shaft.

8. A camshaft assembly as claimed in claim 7, wherein each pin part is hollow and is locked in position by insertion of a separate fixing peg into each pin part.

9. A camshaft assembly as claimed in claim 7, wherein each pin part is hollow and their central bores are machined after assembly to form a straight bore for receiving a single fixing peg common to the two pin parts.

* * * * *